US008752214B1

(12) United States Patent
Maldonado

(10) Patent No.: US 8,752,214 B1
(45) Date of Patent: Jun. 17, 2014

(54) POSITIONING BRACE FOR A KNEEPAD

(76) Inventor: Miguel Maldonado, Gilroy, CA (US)

( * ) Notice: Subject to any disclaimer, the term of this patent is extended or adjusted under 35 U.S.C. 154(b) by 254 days.

(21) Appl. No.: 12/870,386

(22) Filed: Aug. 27, 2010

Related U.S. Application Data

(63) Continuation-in-part of application No. 12/605,731, filed on Oct. 26, 2009, now abandoned.

(51) Int. Cl.
*A41D 13/00* (2006.01)

(52) U.S. Cl.
USPC ..... 2/24; 2/22

(58) Field of Classification Search
USPC ..... 2/22, 23, 24, 62, 911, 267, 227, 79, 2/302, 255; 24/522, 527
See application file for complete search history.

(56) References Cited

U.S. PATENT DOCUMENTS

| | | | | | |
|---|---|---|---|---|---|
| 395,228 | A | | 12/1888 | Harris | |
| 554,776 | A | | 2/1896 | Davis et al. | |
| 696,764 | A | * | 4/1902 | Shibe | 2/22 |
| 752,297 | A | * | 2/1904 | Parker | 2/256 |
| 858,319 | A | * | 6/1907 | Adams | 450/145 |
| 909,215 | A | * | 1/1909 | Pierce et al. | 2/22 |
| 926,328 | A | | 6/1909 | Horath et al. | |
| 2,031,682 | A | * | 2/1936 | Wappler et al. | 606/46 |
| 2,432,565 | A | | 12/1947 | Ferguson | |
| 2,484,494 | A | * | 10/1949 | Ferguson | 2/24 |
| 2,565,762 | A | | 8/1951 | Ferguson | |
| 2,733,443 | A | | 2/1956 | Holder | |
| 3,856,016 | A | * | 12/1974 | Davis | 128/831 |
| 4,064,881 | A | * | 12/1977 | Meredith | 606/142 |
| 4,632,097 | A | * | 12/1986 | Brooks | 602/16 |
| 4,772,071 | A | | 9/1988 | Richards | |
| 4,794,675 | A | * | 1/1989 | Bisconti | 24/455 |
| 4,876,745 | A | | 10/1989 | Richards | |
| 5,007,415 | A | * | 4/1991 | Marion | 602/26 |
| 5,435,563 | A | * | 7/1995 | Salvatore | 473/215 |
| 5,662,594 | A | * | 9/1997 | Rosenblatt | 602/16 |
| 5,675,841 | A | * | 10/1997 | Jackson | 2/175.7 |
| 5,732,411 | A | * | 3/1998 | Coleman et al. | 2/22 |
| 5,758,914 | A | * | 6/1998 | Ioveno | 292/288 |
| 5,794,261 | A | * | 8/1998 | Hefling | 2/16 |
| 6,205,583 | B1 | * | 3/2001 | Beland | 2/16 |
| 6,389,605 | B2 | * | 5/2002 | Srivastava | 2/312 |
| 6,393,610 | B1 | * | 5/2002 | Parks | 2/22 |
| 6,427,239 | B1 | | 8/2002 | Worden | |
| 6,637,034 | B1 | | 10/2003 | Worden | |
| 6,795,974 | B1 | * | 9/2004 | Howell | 2/22 |
| 7,125,392 | B2 | * | 10/2006 | Scott | 602/23 |
| 7,357,191 | B1 | | 4/2008 | Halko, Jr. et al. | |
| 7,409,725 | B1 | * | 8/2008 | Horstman | 2/22 |
| 7,512,996 | B2 | | 4/2009 | Yoo et al. | |
| 7,681,248 | B2 | * | 3/2010 | Legenstein | 2/24 |
| 7,937,769 | B2 | * | 5/2011 | Richards | 2/22 |
| 8,141,169 | B2 | * | 3/2012 | Saranga | 2/22 |
| 2008/0168589 | A1 | | 7/2008 | Richards | |
| 2008/0178361 | A1 | | 7/2008 | Yoo et al. | |
| 2008/0295213 | A1 | * | 12/2008 | McDaniel | 2/24 |
| 2010/0281594 | A1 | * | 11/2010 | Paterno | 2/24 |

* cited by examiner

*Primary Examiner* — Khoa Huynh
*Assistant Examiner* — Andrew W Collins
(74) *Attorney, Agent, or Firm* — Thomas Schneck; Gina McCarthy

(57) ABSTRACT

An adjustable kneepad support that is a brace formed by a pair of elongated, flexible, overlapping thin beam members that are movable relative to each other for lengthwise adjustment. Flexing of the beam members allows operation of a flex-latch that can release a fixed position of the beam members to allow sliding of the members to a newly adjusted lengthwise position.

12 Claims, 5 Drawing Sheets

POSITIONING BRACE FOR A KNEEPAD

CROSS REFERENCE TO RELATED APPLICATION

This is a continuation-in-part of pending U.S. patent application Ser. No. 12/605,731 filed Oct. 26, 2009.

TECHNICAL FIELD

The present invention relates to supports for kneepads and particularly to an adjustable height kneepad support for retaining a kneepad in place.

BACKGROUND ART

The main function of kneepads has always been to protect and comfort people who use their knees or kneel for long periods of time while performing certain activities such as gardening, painting, and in particular, construction work. Workers in the construction industry often kneel or crawl on hard surfaces throughout the day. Many of the kneepads on the market today have various attachment devices, but few provide lasting comfort or protection for prolonged periods of time.

One primary complaint of kneepads on the market today is that the cushioned pad, worn on the knee, must constantly be readjusted as soon as the elastic bands or straps become loose, which causes the pad to move down to the shins. Kneepad straps constantly need adjusting and tightening, an inconvenience for a worker.

U.S. Pat. No. 926,328, issued Jun. 29, 1909 to Horath, describes a miner's kneepad which is worn with a harness comprising two side braces which extend from the outer edges of the kneepad down to an ankle and instep strap arrangement for securing the kneepad in position.

U.S. Pat. No. 554,776, issued Feb. 18, 1896 to Davis et al., discloses a kneepad with side bars that extend from the ankle to the side of the knee and are adjustably attached to the outer sides of the kneepad. The lower ends of the side bars have a harness for attaching to the wearer's foot.

U.S. Pat. No. 395,228, issued Dec. 25, 1888 to Harris, indicates a coal miner's knee shoe which comprises a cup made to fit over a person's knee while in the kneeling position and a thin shin protecting board hingedly attached to the knee cup which also holds the cup up in its place.

U.S. Pat. No. 4,772,071, issued Sep. 20, 1988 to Richards, shows kneepads which are to be worn while a person is working on a surface in a kneeling positioning have a first section provided with a first portion to be attached to a lower leg and a knee seat to accommodate the knee cap and the upper portion of the tibia, a second section connected to the first section and having a seat for a buttock and the adjacent portion of the upper leg and a support engageable with the surface when the user is kneeling with body weight transferred to the surface by the kneepad rather than through the knee joint.

U.S. Pat. No. 2,432,565, issued Dec. 16, 1947 to Ferguson, claims a kneepad comprising a shank which is detachably securable the front of the workman's lower leg. The knee is supported in a padded annular depression formed in the top of the shank. The shank is secured to the leg by a top strap and a bottom ankle strap. The device is further provided with adjustable brackets which allow the kneeling workman to rest his foot in a natural position.

Two U.S. Pat. No. 6,427,239, issued Aug. 6, 2002 and U.S. Pat. No. 6,637,034 issued Oct. 28, 2003 to Worden, concern a weight distributing kneepad which includes a lower leg support adapted to closely engage a lower leg of a user and a knee cover which conforms to the shape of a knee but is physically separate therefrom. A curved portion connects the lower leg support and the knee cover. A strap is included which is adapted to engage an ankle of a user.

U.S. Pat. No. 2,733,443, issued Feb. 7, 1956 to Holder, shows a leg, knee and foot guard and support comprising a rigid elongated frame for wearing on the knee and shin. The frame is strapped onto the leg behind the knee and at the ankle and has a foot guard for supporting the foot off the ground while in a kneeling position.

U.S. Pat. No. 2,565,762, issued Aug. 28, 1951 to Ferguson, relates to a knee and foot support which comprises a shin-worn shank having a kneepad adjustably attached thereto.

U.S. Patent Application No. 2008/0178361, published Jul. 31, 2008 by Yoo et al., describes a protective knee covering which provides motion guidance and orthotic support for a knee. The protective knee covering is made from a layer of rigid material, such as a plastic or a composite material. A central portion of the protective knee covering covers the knee cap portion of the knee. The central portion is curved in a top to bottom direction, but is flat or substantially flat in a medial side to lateral side portion are attached to the central portion at angles. The lateral side portion is attached at a sharper angle than the medial side portion. Both of these portions cover the sides of the knee. The lateral side portion acts as an orthotic guide during bending of the knee to keep the thigh over the knee.

U.S. Pat. No. 7,512,996, issued Apr. 7, 2009 to Yoo et al., puts forth a protective knee covering which provides motion guidance and orthotic support for a knee. The protective knee covering is made from a layer of rigid material, such as a plastic or a composite material. A central portion of the protective knee covering covers the knee cap portion of the knee. The central portion is curved in a top to bottom direction, but is flat or substantially flat in a medial side to lateral side direction to provide a stable base for kneeling. A medial side portion and a lateral side portion are attached to the central portion at angles. The lateral side portion is attached at a sharper angle than the medial side portion. Both of these portions cover the sides of the knee. The lateral side portion acts as an orthotic guide during bending of the knee to keep the thigh over the knee.

U.S. Pat. No. 7,357,191, issued Apr. 15, 2008 to J. Halls et al. describes a vertically adjustable equine leg rest strapped to a human leg.

What is needed is an adjustable vertical brace extending from a shoe or boot of the wearer up to the kneepad and attached to the kneepad to prevent the kneepad from slipping down.

SUMMARY OF INVENTION

In brief, a height adjustable kneepad support comprises an elongated, two-piece vertical brace which attaches to the bottom of a common kneepad outer shell by a clamping jaw. The base of this brace is curved and designed to sit on the rim of the wearer's shoe or boot to support the kneepad. This unique design eliminates dropping of the kneepad and the need for readjustment. The two-piece construction of this kneepad brace allows it to be telescopically adjusted in length to conform to the wearer's height. Various kneepads can be used.

The kneepad brace of the present invention is attached to the wearer around the leg by an elastic strap with an easily detachable hook and loop fastener. It can be worn by workers wearing long or short pants and does not cause excessive tension on the leg.

The support is a lengthwise brace having top and bottom elongated, flexible overlapping thin beam members that are movable relative to each other for lengthwise adjustment. The top beam member has a lower retainer through which the bottom beam member passes, and a downwardly extending portion with a protuberance. The bottom beam member lies an upper retainer through which the top beam member passes and a series of lengthwise spaced-apart detents that can seat the protuberance in a to selected detent. Flexing of the top and bottom beam members lifts the protuberance out of a detent. Pushing or pulling on the beams allows the protuberance to move to another detent thereby adjusting the length of the support.

Flexing of the beams is essential to allow vertical adjustment as described above. Polycarbonate is an ideal exemplary beam material since it is strong, light weight and flexes without breaking or cracking. Other flexing, semi-rigid materials can be used including metals and other plastics. The protuberance and detents act as a latch that operates on flexing of the beam members. The flex-latch is integral with the beam members and preferably not a separate structure.

DESCRIPTION OF INVENTION

Figure 1:
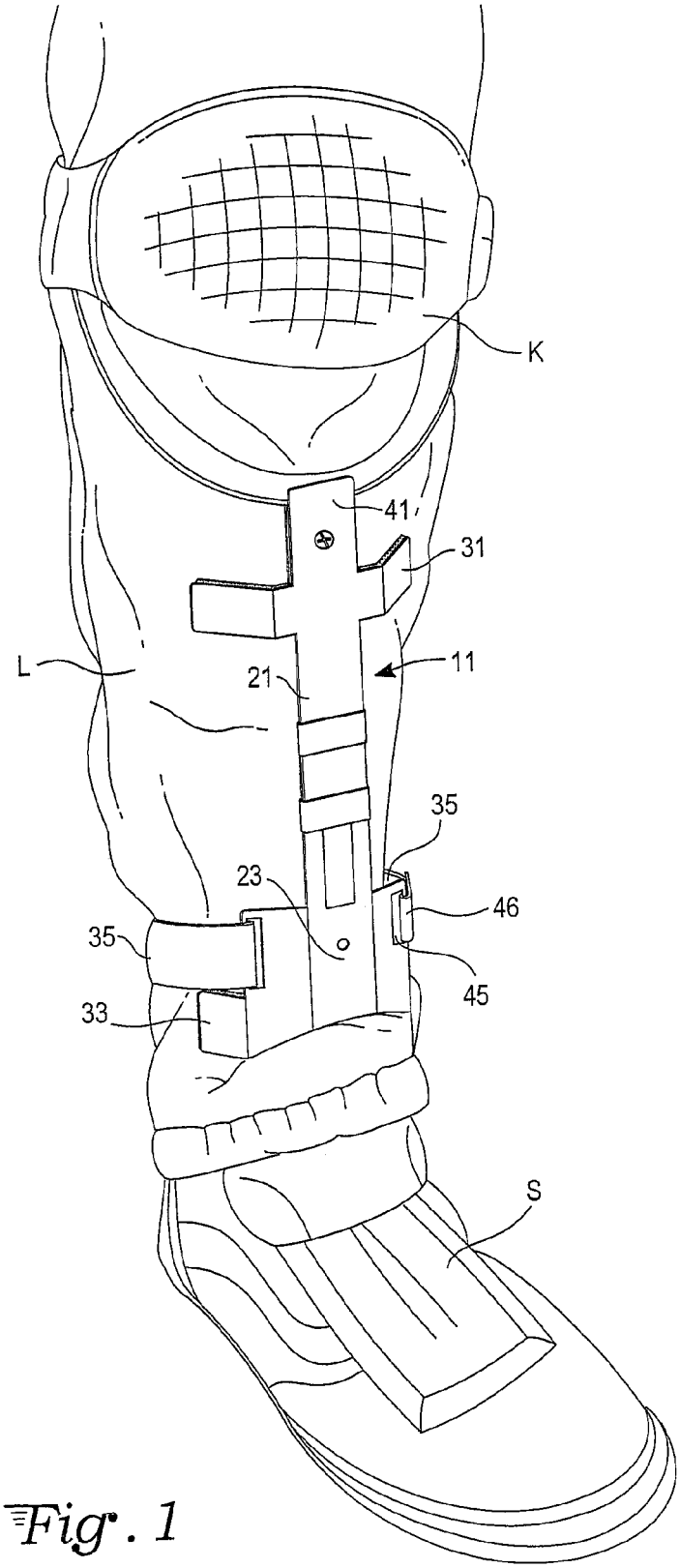
FIG. 1 is a perspective view of an knee brace of the present invention fixing the position of a kneepad to the leg of a user supported by a user shoe.

With reference to FIG. 1, a user with a leg L has a kneepad K and a shoe S. A kneepad support 11 in accordance with the invention extends between the kneepad K and the shoe S keeping the kneepad in place. The support acts as a brace between the shoe and the kneepad. The brace may be seen to be linear having a lengthwise extent between the shoe and the kneepad. A leg support cross arm 31 positions the brace against the user leg L just below kneepad K by gripping the kneepad K at a lower lip of the kneepad using the jaw 41 to clamp the brace to the kneepad. A shoe support cross arm 33 positions the brace against the user leg must above shoe S. A leg strap 35 secures the brace against leg L and keeps the kneepad support 11 in place. The brace itself has top and bottom overlapping beam members 21 and 23 respectively. The beams are thin, flat, flexible members explained in greater detail below.

Figure 2:
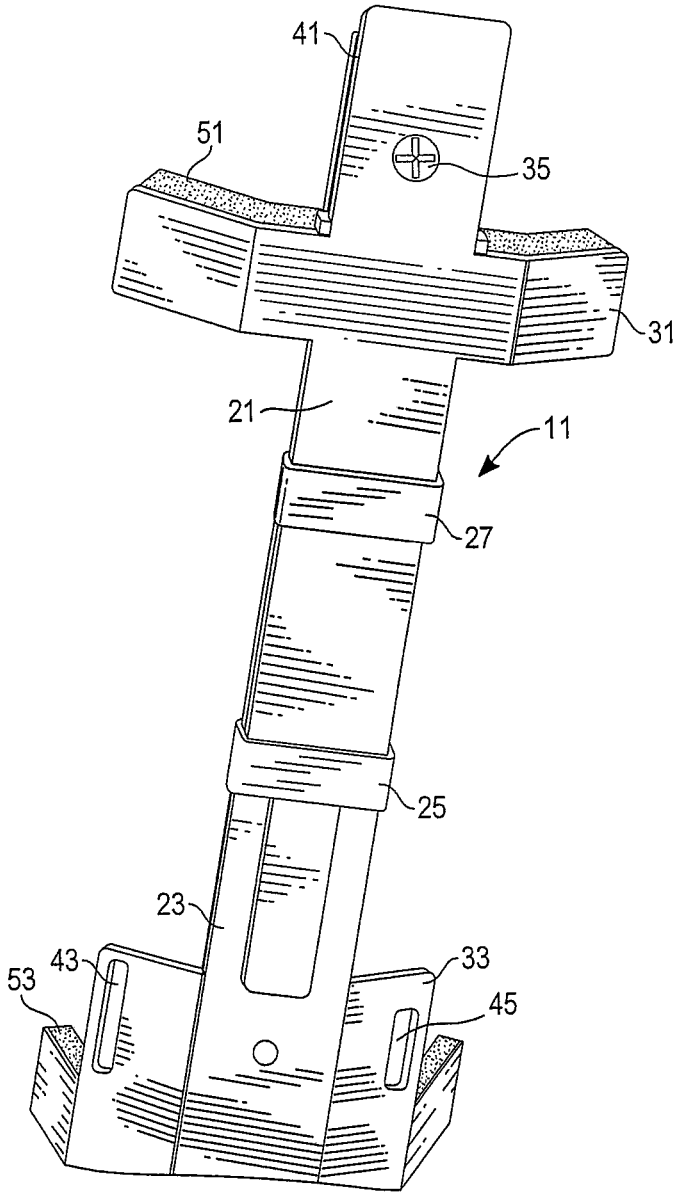
FIG. 2 is a front perspective view of the apparatus of FIG. 1.

With reference to FIG. 2, the top beam member 21 is seen to have a lower retainer ring 25 which is an oblong ring that is fixed to the top beam member 21 but slides over the bottom beam member. The lower beam member 23 is seen to have an upper retainer ring 27 that has the same oblong shape as retainer ring 25 but is fixed to the bottom beam member 23. The retainer ring 27 slides over the top beam member 21. The maximum length of the brace 11 is reached when the top beam member 21 moves upwardly thereby moving the lower retainer ring upwardly until it abuts the upper retainer ring 27. When the two retainer rings are abutting, the top and bottom beam members cannot be Mutually extended further and maximum length has been achieved. The kneepad support is designed such that minimum length is achieved when the retainer rings 25 and 27 abut against one or both of the cross arms 31 and 33, preferably both.

The top and bottom beam members are nominally one inch wide and one-eighth inch thick polymer, such as polyacrylic material. Such thickness allows flexing of the beam members for reasons described below. The cross arms have similar dimensions and should be sufficiently thin to be deformable under pressure or thermal processing to achieve a desired shape conforming to the leg of a user. The dimensions and material mentioned above are exemplary and other dimensions and materials may be used.

Near the top of the top beam member 21 a central screw 37 retains a jaw 41 against the top beam member, as described below. The shoe support cross arm 33 has two slots seen in FIG. 2, including a larger slot 45 and a smaller slot 43. The purpose of the slots is to retain the leg strap 35 seen in FIG. 1. With reference to FIGS. 1 and 2, the overlapping beam members 21 and 23 may be secured on a user's leg L. The strap 35 is attached at one end to the smaller slot 43 and the buckle 46 is attached to larger slot 45. The leg strap 35 passes through the buckle. Returning to FIG. 2, the cross arms have elastomeric foam padding against the leg of a user. Upper foam pad 51 cushions the leg support cross arm 31 against the leg of a user. Lower foam pad 53 cushions shoe support cross arm 33 just above or near the ankle region of a user.

Figure 3:
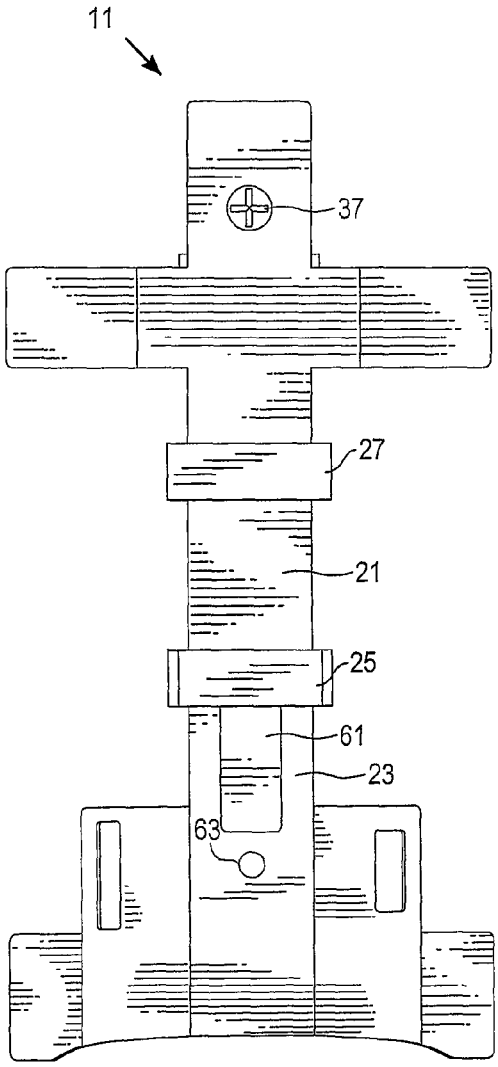
FIG. 3 is a front elevational view of the apparatus of FIG. 1.

With reference to FIG. 3, the top beam member 21 is seen to have a downwardly extending tongue 61 below the lower retainer ring 25. The back side of the tongue carries a protuberance, resembling a perpendicular peg. The protuberance is formed by drilling a hole through the tongue and inserting and then cementing a cylindrical peg that is flush with top beam member on one side but projects slightly outwardly on the back side of the top beam member. The protuberance is seated snugly in a hole in the bottom beam member 23. An exemplary hole 63 is seen below tongue 61.

Figure 4:
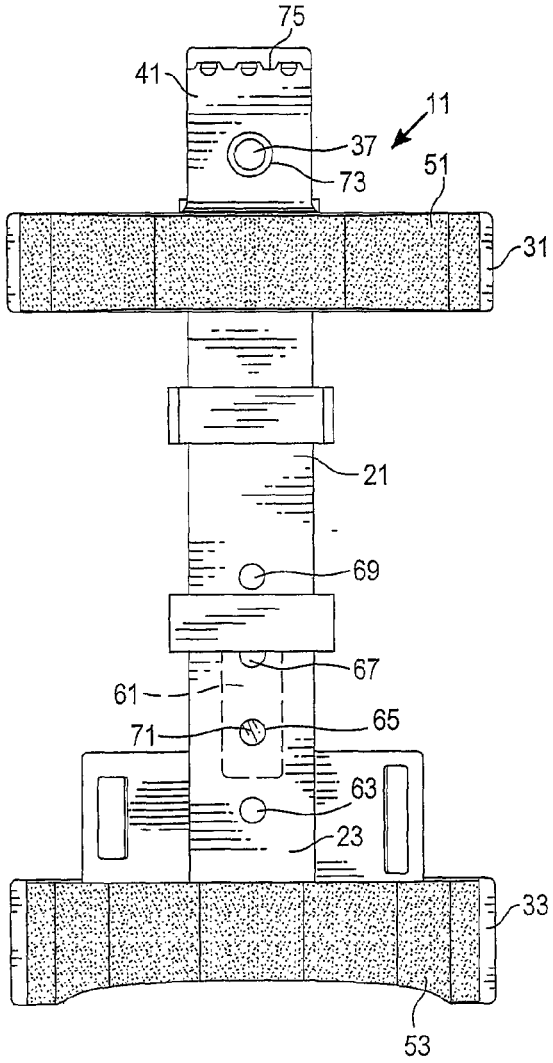
FIG. 4 is a rear elevational view of the apparatus of FIG. 1.

In the backside view of FIG. 4, the holes 63, 65, 67, 69 may be seen with the protuberance 71 visible in hole 65, thereby fixing the length of the brace formed by the adjustable top and bottom beam members 21 and 23. The backside view also reveals the upper foam pad 51 on the leg support cross arm 31 and the foam pad 53 on the shoe support cross arm 33. Also seen in the backside view is the jaw 41 that is held to the top beam member 21 by a screw 37 held in a tubular rivet 73 that is inserted from the backside and extends to the jaw. The screw may be loosened and the jaw 41 and jaw teeth 75 are released, allowing an edge of a kneepad to be inserted in the jaw. The screw is then tightened so that the jaw teeth 75 grip the kneepad edge and clamp it to the top beam member 21.

Figure 5:
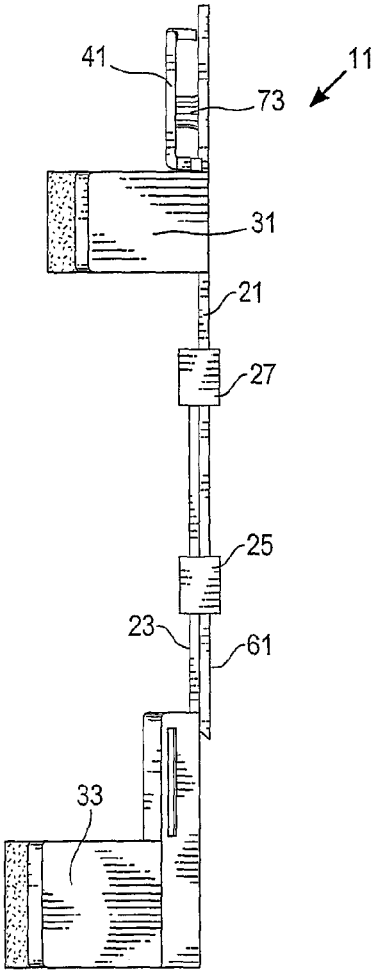
FIGS. 5 and 6 are side views of the apparatus of FIG. 1 in relaxed and flexed states, respectively.
Figure 6:
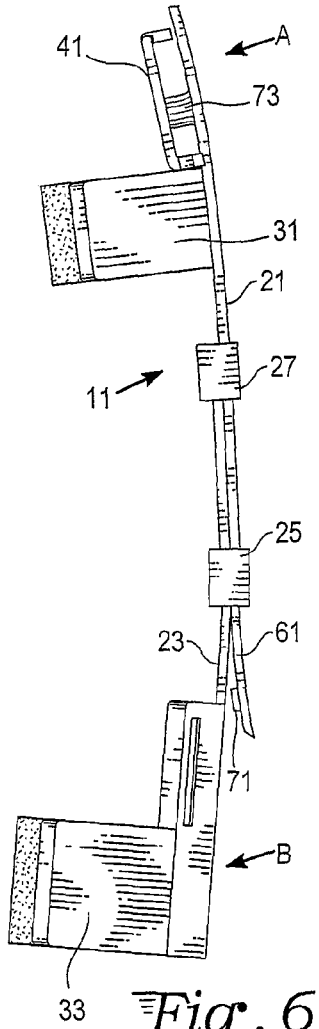

With reference to FIG. 5, the top beam member 21 is seen to rest flat against the bottom beam member 23 in a relaxed state where the position of the beams are fixed relative to each other and the kneepad support 11 has a fixed length. In FIG. 6, the top and bottom beam members are flexed with, force applied in the direction of arrows A and B. As the top beam member pulls away from the bottom beam member 23 at an end of the top beam member, the protuberance 71 is lifted from a hole in which it sits. The protuberance 71 may be slid to another hole in the bottom beam member 23 thereby changing the length of kneepad support 11. To lengthen the kneepad support, the tongue 61, top beam member 21 and lower retainer ring 25 are moved upwardly while the lower beam member 23 and upper retainer ring 27 are moved downwardly until the protuberance seats itself in a desired hole to establish a desired length. In FIG. 6 the jaw 41 is open slightly more than in FIG. 5 with the change in position established by a screw running through the tubular rivet 73.

Figure 7:
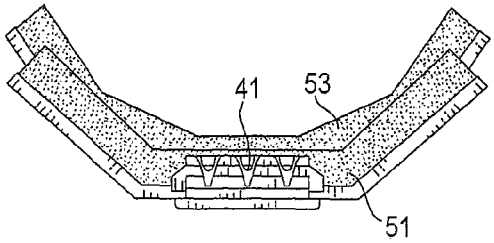
FIG. 7 is a top view of the apparatus of FIG. 1.
Figure 8:
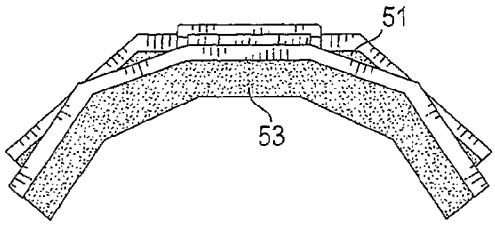
FIG. 8 is a bottom view of the apparatus of FIG. 1.
Figure 9:
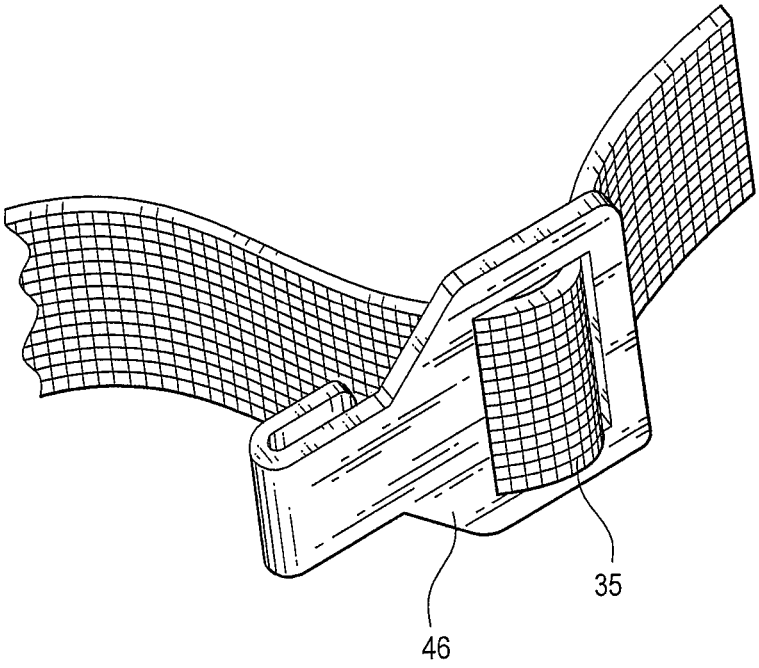
FIG. 9 is a perspective view of a buckle and strap of FIG. 1.

With reference to FIGS. 7 and 8 the curved upper foam pad 51 is seen above the curved lower foam pad 53. The amount of curvature of the two pads is similar but the lower foam pad 53 has a slightly greater curved wrap about the foot and leg of a user. The jaw 41 is disposed immediately above the upper foam pad 51.

What is claimed is:

1. A kneepad support having adjustable length comprising:

flexible top and bottom overlapping flat beam members that lie flat relative to each other and are sufficiently thin for flexing and are slideably connected to each other with one of the overlapping beam members having a first latch member that locks with a second latch member in the other overlapping beam member when beam members are flat but releases when beam members are flexed, the top beam member having a jaw adapted to grip a kneepad and the bottom beam member having a transverse shoe support crossarm curved to be supported above the rim of a wearer's shoe or boot with a leg strap.

2. The apparatus of claim 1 wherein the top and bottom beams have curved cross arms wrapping partly about the leg of a user.

3. The apparatus of claim 1 wherein the first latch member is a protuberance in one of the beam members and the second latch member is a series of uniform holes in the other beam member wherein the protuberance fits into the holes thereby providing a selected adjustable length to the kneepad support.

4. A kneepad support having adjustable length comprising:

top and bottom elongated flexible overlapping beam members that lie flat relative to each other and are sufficiently thin for flexing, the top beam member having a lower retainer ring and having a downwardly extending tongue with a protuberance, the top beam member having a transverse pad support crossarm and a pad jaw above the pad support crossarm adapted to grip a kneepad, the bottom elongated flexible beam having an upper retainer ring, the bottom beam having lengthwise spaced apart detents each having a size seating said protuberance, the bottom beam having a transverse shoe support crossarm curved to be supported above the rim of a wearer's shoe or boot, the crossarm having laterally spaced apart leg strap slots, the top and bottom beams slideably overlapping at least between the upper and lower retainer rings and to an extent whereby the protuberance on the tongue may be seated in a selected detent thereby adjusting the length of the support, the upper and lower retainer rings mutually limiting the extent of sliding motion of the top and bottom beams; and a leg strap communicating with the leg strap slots;

whereby flexing the flat top and bottom arms allows the protuberance to lift out of a detent such that pushing or pulling on the beams allows the protuberance to slide on the bottom beam to another detent thereby adjusting the length of the support.

5. The apparatus of claim 4 wherein the pad support is curved with a curvature following leg curvature.

6. The apparatus of claim 5 wherein the pad support has an elastomeric lining.

7. The apparatus of claim 4 wherein the shoe support is curved with a curvature following shoe curvature.

8. The apparatus of claim 7 where the shoe support has an elastomeric lining.

9. The apparatus of claim 4 wherein the pad jaw comprises a first set of teeth on an upper end of the top beam member and a biased tab with a second set of teeth facing the first set of teeth.

10. The apparatus of claim 9 wherein a screw and rivet provide compressive bias for said biased tab.

11. The apparatus of claim 4 wherein the upper and lower retainer rings have an oblong shape.

12. The apparatus of claim 4 wherein the top and bottom beam members are generally flat and pad support and shoe support are angularly curved laterally outwardly from the beam members.

* * * * *